US012455107B2

(12) United States Patent
Lee

(10) Patent No.: US 12,455,107 B2
(45) Date of Patent: Oct. 28, 2025

(54) REFRIGERATOR

(71) Applicant: LG ELECTRONICS INC., Seoul (KR)

(72) Inventor: Sangmyung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 213 days.

(21) Appl. No.: 18/017,763

(22) PCT Filed: Jul. 29, 2021

(86) PCT No.: PCT/KR2021/009868
§ 371 (c)(1),
(2) Date: Jan. 24, 2023

(87) PCT Pub. No.: WO2022/025659
PCT Pub. Date: Feb. 3, 2022

(65) Prior Publication Data

US 2023/0280079 A1 Sep. 7, 2023

(30) Foreign Application Priority Data

Jul. 29, 2020 (KR) ..... 10-2020-0094398

(51) Int. Cl.
*F25D 17/06* (2006.01)
*F25D 23/06* (2006.01)

(52) U.S. Cl.
CPC ..... *F25D 17/062* (2013.01); *F25D 23/062* (2013.01); *F25D 2317/063* (2013.01)

(58) Field of Classification Search
CPC . F25D 17/062; F25D 2317/063; F25D 23/062
See application file for complete search history.

(56) References Cited

U.S. PATENT DOCUMENTS

2010/0320890 A1* 12/2010 Jung ..... F25D 27/00 312/405
2015/0135736 A1* 5/2015 Kim ..... F25D 29/00 62/126

FOREIGN PATENT DOCUMENTS

| | | | | |
|---|---|---|---|---|
| CN | 104296491 | | | 2/2017 |
| CN | 208312847 | U | * | 1/2019 |
| CN | 110230911 | A | * | 9/2019 |
| JP | H07318234 | A | * | 12/1995 |
| JP | H0486729 | U | * | 10/1996 |
| JP | H08-303945 | | | 11/1996 |
| JP | H08303945 | A | * | 11/1996 |
| KR | 10-1999-0062168 | | | 7/1999 |
| KR | 19990062168 | A | * | 7/1999 |
| KR | 10-0797219 | | | 1/2008 |

(Continued)

OTHER PUBLICATIONS

Translated_Hwan (Year: 2018).*

(Continued)

*Primary Examiner* — Jerry-Daryl Fletcher
*Assistant Examiner* — Samba N Gaye
(74) *Attorney, Agent, or Firm* — KED & ASSOCIATES, LLP

(57) ABSTRACT

A refrigerator can easily detect the withdrawal of a vegetable box that can be withdrawn in the forward direction, due to the placement of a magnetic structure and a switch for detecting the withdrawal of the vegetable box at the rear part of the vegetable box.

15 Claims, 13 Drawing Sheets

(56) References Cited

FOREIGN PATENT DOCUMENTS

| | | | | |
|---|---|---|---|---|
| KR | 2010064551 | A | * | 6/2010 |
| KR | 10-2015-0048525 | | | 5/2015 |
| KR | 2018013448 | A | * | 2/2018 |
| KR | 10-2023014 | | | 11/2019 |

OTHER PUBLICATIONS

Translated_Lee (Year: 2010).*
Translated_Yuuji (Year: 1995).*
Translated_Song (Year: 1999).*
Translated_Wang (Year: 2019).*
Translated_Kishinaka (Year: 1996).*
Translated_Kramer (Year: 2019).*
Translated_Kawai (Year: 1996).*
International Search Report dated Nov. 2, 2021 issued in Application No. PCT/KR2021/009868.

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2021/009868, filed Jul. 29, 2021, which claims priority to Korean Patent Application No. 10-2020-0094398, filed Jul. 29, 2020, whose entire disclosures are hereby incorporated by reference.

TECHNICAL FIELD

The present disclosure relates to a refrigerator.

BACKGROUND ART

A refrigerator may include a camera for acquiring an internal image of a storage space. The camera may operate according to an imaging start signal to capture an image of a specific portion of the inside of the refrigerator.

The refrigerator may further include a box capable of being withdrawn forward. The box may include a box body in which stored objects are accommodated and a cover covering an upper portion of the box body.

In order for the camera to capture the image of the stored objects inside the box, the box needs to be withdrawn to expose the inner space of the box body to the outside of the box body. That is, the imaging start signal of the camera may be configured by a signal for detecting that the box is withdrawn.

A switch may be provided inside the refrigerator to detect that the box has been withdrawn. The switch needs to be installed at a distance adjacent to the box.

However, in order to secure a maximum storage space of the refrigerator, the size of the box needs to be configured as large as possible. At this time, as the switch is located adjacent to the box, it is necessary to set a position where the switch does not interfere with main parts inside the refrigerator.

In particular, when a structure in which a cold air flow path is installed in an inner case of the refrigerator is employed and the switch and the cold air flow path are located on a sidewall of the inner case, there is a possibility that the cold air flow path and the switch may interfere.

In addition, there may be a possibility that the switch is contaminated by the stored object (moisture) stored in the refrigerator.

INVENTION

Technical Problem

The embodiment of the present disclosure is proposed to solve the above problems, and an object of the present disclosure is to provide a refrigerator in which a switch is provided on a rear wall of a storage space of the refrigerator to detect whether a vegetable box is withdrawn, so that interference between the switch and a cold air duct on a sidewall of the storage space is capable of being prevented.

An object of the present disclosure is to provide a refrigerator in which a switch is located adjacent to a vegetable box and can be easily installed or removed by mounting the switch on a grille fan located in a rear portion of a storage space of the refrigerator (service ease).

An object of the present disclosure is to provide a refrigerator in which a magnetic assembly capable of working with a switch is provided on a rear portion of a vegetable box to increase the reliability of the operation of the switch.

An object of the present disclosure is to provide a refrigerator in which a pocket in which a magnetic assembly may be accommodated is provided in a rear portion of a vegetable box, so that installation or separation of the magnetic assembly is easy.

An object of the present disclosure is to provide a refrigerator in which a drainage structure is provided in a pocket and a magnetic assembly so that a stored object stored in the refrigerator or moisture generated from the stored object can be easily discharged even if it flows into the magnetic assembly and the pocket.

An object of the present disclosure is to provide a refrigerator capable of preventing a magnetic assembly from being separated from a pocket even if shaking occurs in a process of withdrawing or retracting a vegetable box, by a press-fitting method such that the magnetic assembly is stably coupled to the pocket.

An object of the present disclosure is to provide a refrigerator capable of securing operation reliability of a switch and a camera, by providing a camera on an upper portion of a storage space of the refrigerator, providing a switch on a rear portion of a vegetable box, detecting that the vegetable box is withdrawn by the switch when the vegetable box is withdrawn forward by a predetermined distance, and capturing an image by the camera according to the detected signal.

Technical Solution

In order to solve the above problems, in a refrigerator according to an embodiment of the present disclosure, a magnetic structure and a switch for detecting withdrawal of a vegetable box are disposed at a rear portion of the vegetable box that is provided to be able to be withdrawn forward, thereby easily detecting withdrawal of the vegetable box.

Since a cold air duct for supplying cold air to a refrigerator door is provided on a sidewall of a storage space of the refrigerator, and a switch for detecting the withdrawal of the vegetable box is provided on a rear wall of the storage space, interference between the cold air duct and the switch can be prevented.

An evaporator and a blowing fan are provided at the rear side of the storage space of the refrigerator, and a grille fan is disposed in front of the blowing fan. And, since a switch is installed in the grill pan, installation or separation of the switch may be easy.

A pocket is provided on a rear portion of the vegetable box, and a magnetic assembly is accommodated in the pocket, so that installation of the magnetic assembly may be easy.

Since the magnetic assembly may be fixed by being press-fitted into the pocket, it is possible to prevent the magnetic assembly from being separated from the pocket even if shaking occurs in the process of withdrawing or retracting the vegetable box.

The magnetic assembly may include a magnetic and a magnetic cover that forms a space into which the magnetic is inserted, thereby preventing the magnetic from being exposed to the storage space.

The magnetic cover is formed with a groove through which liquid stored in the storage space or moisture generated from a stored object can be discharged, so that, even if the liquid or moisture flows into the magnetic assembly, drainage of the liquid or moisture can be facilitated.

A camera is provided on an upper wall of the storage space of the refrigerator, and the angle of view of the camera is formed to be inclined backward toward the vegetable box, so it may be easy to capture the image of the inside of the vegetable box.

When the switch detects the withdrawal of the vegetable box by a predetermined distance, the detection signal acts as an imaging start signal of the camera, so that the operation of the camera can be performed easily.

A refrigerator according to an embodiment of the present disclosure may comprise a cabinet forming a storage space, a door configured to open and close the storage space and forming an ice making space, a cold air duct provided in a sidewall of the storage space and configured to supply cold air to the ice making space, a box provided in the storage space to be withdrawn forward, a grille fan forming a rear wall of the storage space and located in front of a blowing fan, and a detection device provided in the box and the grille fan and configured to detect whether the box is retracted or withdrawn.

The detection device may include a magnetic and a switch for performing a magnetic operation with the magnetic.

The box may include a rear portion facing the grille fan, and the magnetic may be provided in the rear portion of the box and the switch is provided in the grille fan.

The rear portion of the box may include a pocket in which the magnetic is installed, and the pocket has a pocket hole through which liquid flowing to the magnetic is discharged.

The box may include a box body having an open upper portion and a box cover covering an upper side of the box body, and the pocket may be provided in an upper edge portion of the box body.

The pocket may include a pocket front portion, pocket side portions at both sides of the pocket front portion and a pocket rear portion connecting the both pocket side portions, and upper ends of the pocket front portion and the pocket rear portion may be opened so that the magnetic is inserted.

The pocket may further include a pocket bottom portion connecting lower ends of the pocket front portion and the pocket rear portion, and the pocket hole may be formed in the pocket bottom portion.

The refrigerator may further include a magnetic cover forming an accommodation space, into which the magnetic is inserted, and inserted into the pocket.

The magnetic cover may include a cover front portion and cover rear portion facing each other, cover side portions at both sides of the cover front portion and a cover upper portion connecting the cover front portion and the cover rear portion.

The magnetic cover may include an open lower end such that the magnetic is inserted thereinto, and an upper side of the magnetic may be shielded by the cover upper portion.

The magnetic cover may include an assembly rib, and the assembly rib may be inserted into an assembly groove formed in an inner surface of the pocket.

A first contact rib may be provided on an outer surface of the magnetic cover, and the first contact rib may contact an inner surface of the pocket so that the magnetic cover is press-fitted into the pocket.

A second contact rib may be provided in an inner surface of the magnetic rib, and the second contact rib may contact the inner surface of the magnetic cover so that the magnetic is press-fitted into the magnetic cover.

A drain groove for guiding fluid flowing into the pocket to flow to the pocket hole may be formed in an outer surface of the magnetic cover.

The drain groove may be formed in the cover front portion, cover rear portion and cover side portions of the magnetic cover, respectively.

The refrigerator may further include a switch cover mounted on the grilled fan and forming an installation space of the switch, and a front surface of the switch may be exposed toward the rear portion of the box so that the switch faces the magnetic.

The refrigerator may further include a camera provided on an upper wall of the storage space and configured to capture an image of the box.

Effect of the Invention

According to the embodiment, a switch is provided on a rear wall of a storage space of a refrigerator to detect whether a vegetable box is withdrawn, so that interference between the switch and a cold air duct on a sidewall of the storage space is capable of being prevented.

A switch is located adjacent to a vegetable box and can be easily installed or removed by mounting the switch on a grille fan located in a rear portion of a storage space of the refrigerator (service ease).

A magnetic assembly capable of working with the switch is provided on a rear portion of a vegetable box to increase the reliability of the operation of the switch.

A pocket in which a magnetic assembly may be accommodated is provided in a rear portion of a vegetable box, so that installation or separation of the magnetic assembly may be easy.

A drainage structure is provided in a pocket and a magnetic assembly so that a stored object stored in the refrigerator or moisture generated from the stored object can be easily discharged even if it flows into the magnetic assembly and the pocket.

It is possible to prevent a magnetic assembly from being separated from a pocket even if shaking occurs in a process of withdrawing or retracting a vegetable box, by a press-fitting method such that the magnetic assembly is stably coupled to the pocket.

It is possible to secure operation reliability of a switch and a camera, by providing a camera on an upper portion of a storage space of the refrigerator, providing a switch on a rear portion of a vegetable box, detecting that the vegetable box is withdrawn by the switch when the vegetable box is withdrawn forward by a predetermined distance, and capturing an image by the camera according to the detected signal.

BEST MODE

Figure 1:
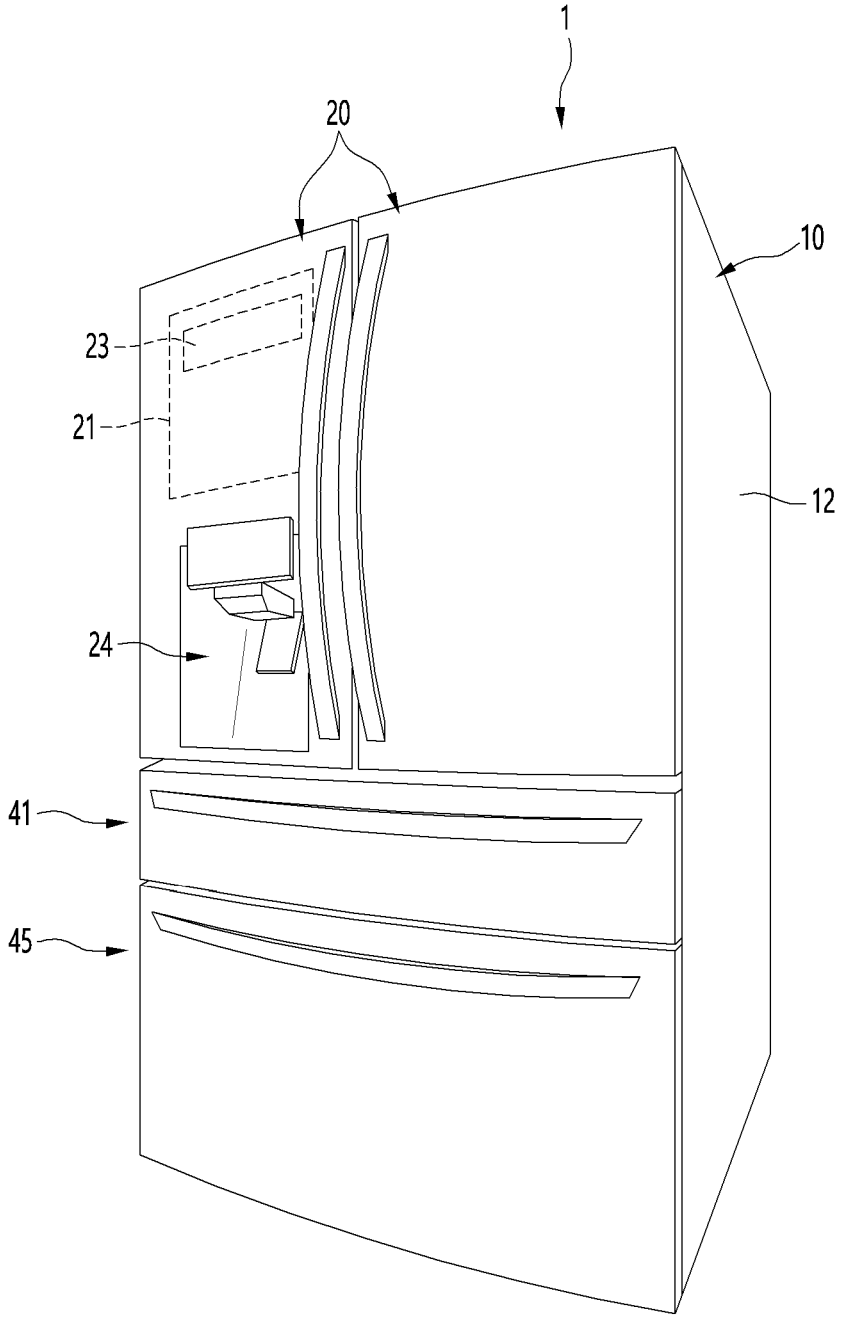
FIG. 1 is a perspective view showing appearance of a refrigerator according to an embodiment of the present disclosure.

Hereinafter, some embodiments of the present disclosure will be described in detail with reference to exemplary drawings. In adding reference numerals to the components of each drawing, it should be noted that the same components are given the same reference numerals as much as possible even though they are shown on different drawings. In addition, in describing the embodiment of the present disclosure, if it is determined that a detailed description of a related known configuration or function interferes with the understanding of the embodiment of the present disclosure, the detailed description thereof will be omitted.

In addition, in describing the components of the embodiment of the present disclosure, terms such as first, second, A, B, (a), (b), etc. may be used. These terms are only for distinguishing the components from other components, and the essence, order, or sequence of the components are not limited by the terms. When it is described that a component is "connected", "coupled" or "linked" to another component, it should be noted that the component may be directly connected or linked to the other component, but another component may also be "connected", "coupled" or "linked" between the components.

Figure 2:
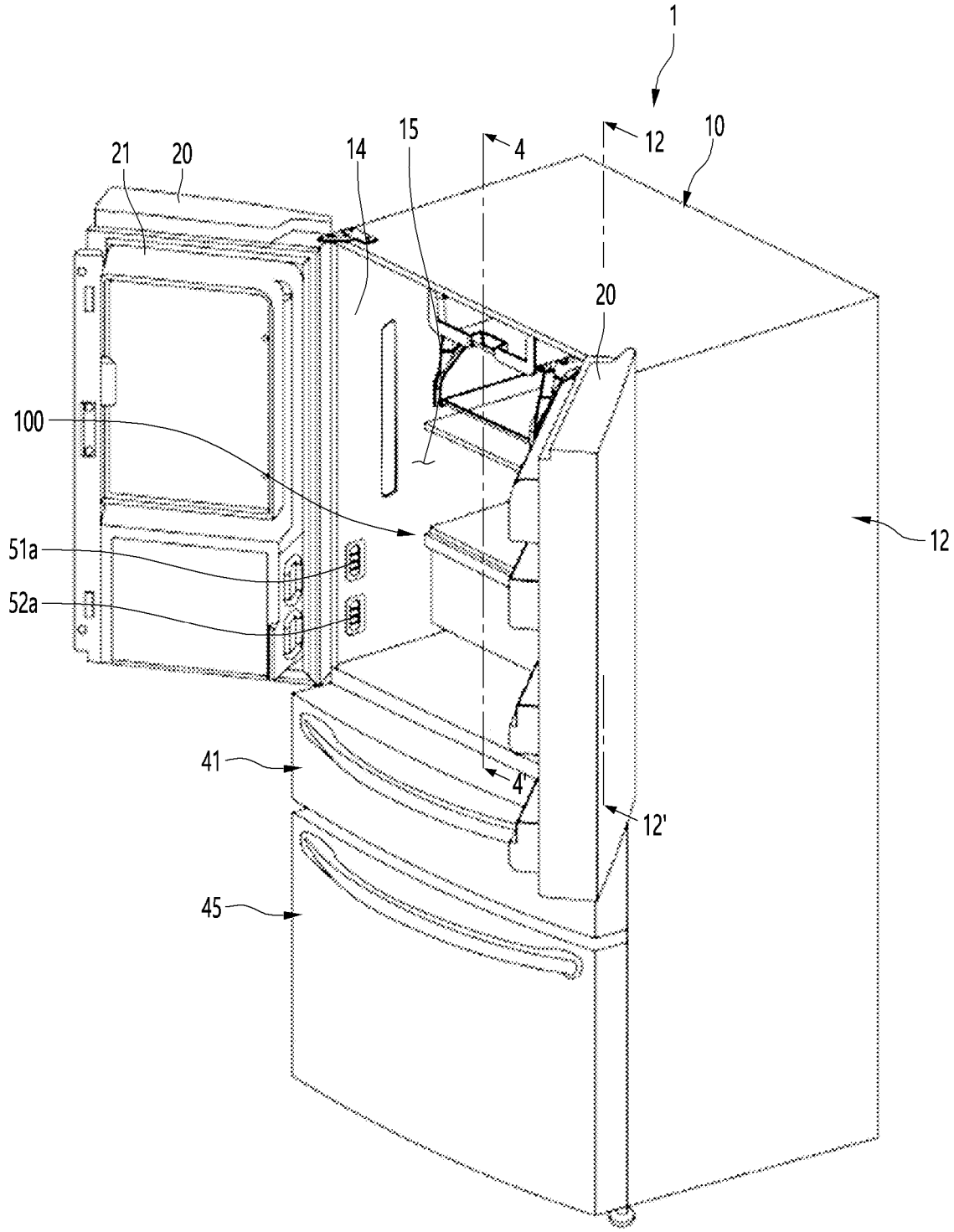
FIG. 2 is a perspective view of a refrigerator, in which a refrigerating space is opened, according to an embodiment of the present disclosure.
Figure 3:
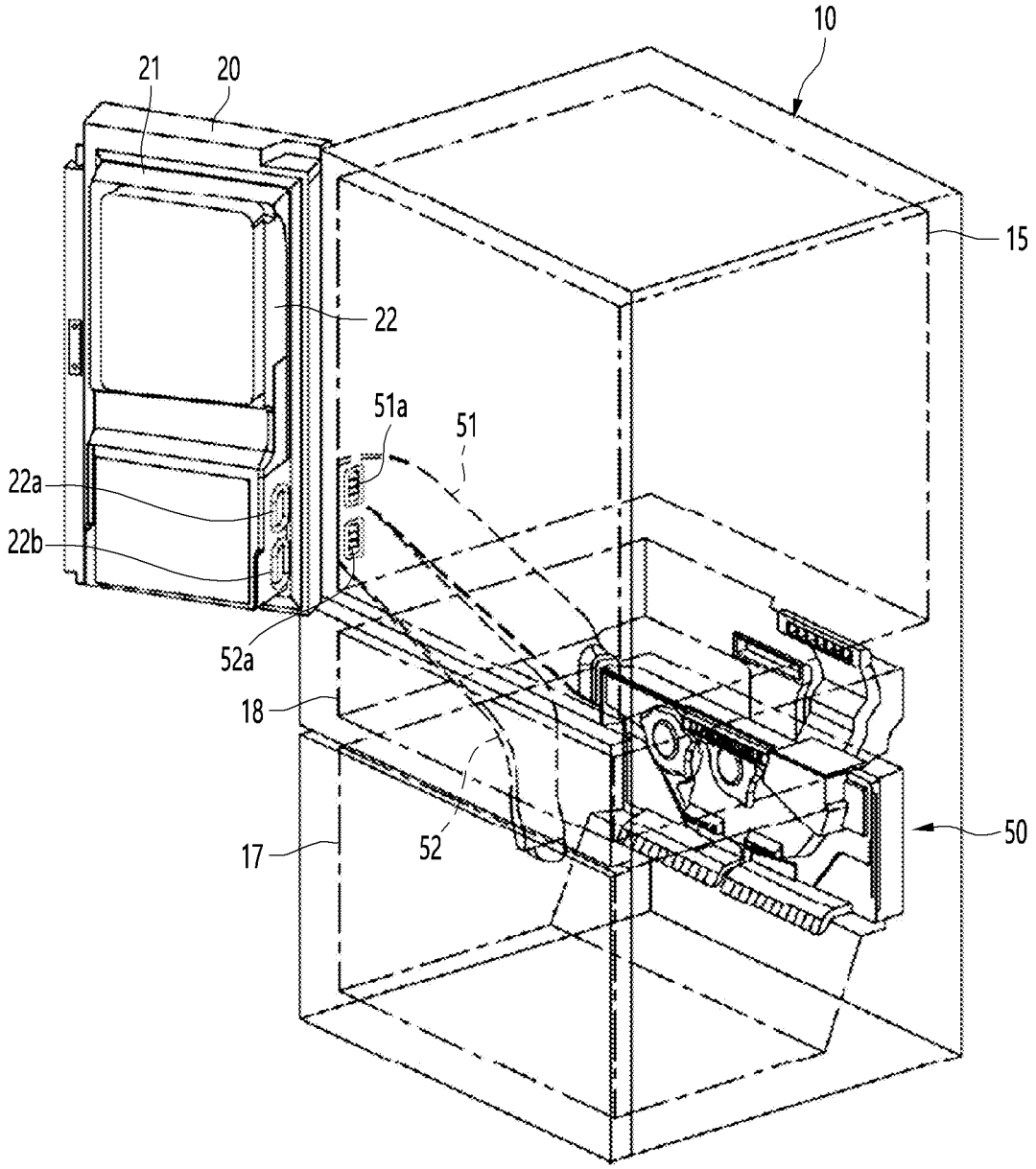
FIG. 3 is an internal perspective view of a refrigerator according to an embodiment of the present disclosure, which shows a configuration of a cold air duct.

FIG. 1 is a perspective view showing appearance of a refrigerator according to an embodiment of the present disclosure. FIG. 2 is a perspective view of a refrigerator, in which a refrigerating space is opened, according to an embodiment of the present disclosure. FIG. 3 is an internal perspective view of a refrigerator according to an embodiment of the present disclosure, which shows a configuration of a cold air duct.

Referring to FIGS. 1 to 3, the refrigerator 1 according to the embodiment of the present disclosure may include a cabinet 10 having a storage space formed therein and doors 20, 41 and 45 for opening and closing the storage space.

The cabinet 10 may include an outer case 12 forming appearance of an upper surface and both sides and an inner case 14 provided inside the outer case 12 and forming the storage space. A space filled with a heat insulating material 15 (see FIG. 5) may be formed between the outer case 12 and the inner case 12.

The inner case 14 may form both sidewalls of the storage space.

The storage space may include a refrigerating space 15, a switching space 16 and a freezing space 17. The storage space 15, 16 and 17 may be arranged in a vertical direction.

The refrigerating space 15 is a space provided in front of a grille fan 90 (see FIG. 4) and may be provided to keep a stored object in a refrigerated state. The grille fan 90 may be configured as a configuration provided in front of a blowing fan to cover the blowing fan.

Specifically, the grille fan 90 may be provided in front of a refrigerating space evaporator 72 (see FIG. 4) and a refrigerating space fan 75 (see FIG. 4) to cover the refrigerating space evaporator 72 and the refrigerating space fan 75.

The switching space 16 and the freezing space 17 may be provided in front of a freezing space fan assembly 50. The freezing space fan assembly 50 may include a freezing space evaporator and a freezing space fan.

A freezing space grille fan covering the freezing space fan assembly 50 may be provided in front of the freezing space fan assembly 50, and the switching space 16 and the freezing space 17 may be provided in front of the freezing space grille fan.

The switching space 16 is a storage space provided to change its use according to user's needs, and may be configured to use the same evaporator as the freezing space 17. The switching space 16 may be used as a refrigerating space or a freezing space. The freezing space 17 may be understood as a storage space provided to keep a stored object in a frozen state.

The refrigerating space 15 is provided at an upper portion of the cabinet 10, the freezing space 17 is provided at a lower portion of the refrigerating space 15, and the switching space 16 may be provided between the refrigerating space 15 and the freezing space 17.

The door includes a refrigerating space door 20, a switching space door 41, and a freezing space door 45. The refrigerating space door 20 is a door that opens and closes the refrigerating space 15 and is a rotary door.

An ice making space 21 is provided inside the refrigerating space door 20 (a side positioned inside the refrigerating space when the refrigerating space door is closed). The ice making space 21 is understood as a storage space in which an ice maker 23 for making ice and an ice bin in which made ice is stored are provided in the refrigerating space door 20.

The inside of the ice making space 21 communicates with a dispenser 24 on a front surface of the refrigerating space door, so that a user may take out the ice stored in the ice making space 21 through the dispenser 24.

The ice making space 21 is configured to receive cold air from an ice making space supply duct 51 through a guide duct 22 and to discharge cold air to an ice making space return duct 52. A combination of the ice making space supply duct 51 and the ice making space return duct 52 may be referred to as a "cold air duct".

The guide duct 22 is provided on the side of the ice making space 21. The ice making space supply duct 51 and the ice making space return duct 52 may be embedded in a sidewall of the storage space. A portion of the ice making space supply duct 51 and a portion of the ice making space return duct 52 may be embedded outside the inner case 14 forming the refrigerating space 15.

Cold air generated in the freezing space fan assembly 50 may be transferred to the guide duct 22 through the ice making space supply duct 51, and may be supplied to the ice making space 21.

A supply port 51*a* communicating with a first guide port 22*a* of the guide duct 22 is formed at an end of the ice making space supply duct 51. The support port 51*a* is exposed on the sidewall of the refrigerating space 15, and is disposed to be brought into contact with or adjacent to a first guide port 22*a* when the refrigerating space door 20 is closed, so that cold air is transferred from the support port 51*a* to the first guide port 22*a*.

Cold air of the ice making space 21 may be transferred to the return port 52*a* of the ice making space return duct 52 through the second guide port 22*b* of the guide duct 22. The return duct 52*a* is exposed on the sidewall of the refrigerating space 15, and is disposed to be brought into contact with or adjacent to the second guide port 22*b* when the refrigerating space door 20 is closed, so that cold air is transferred from the second guide port 22*b* to the return duct 52*a*.

The support port 51*a* and the return duct 52*a* may be disposed on the sidewall of the inner case 14 in the vertical direction. The first and second guide ports 22*a* and 22*b* may be disposed under the guide duct 22 in the vertical direction.

The ice making space supply duct 51 and the ice making space return duct 52 may be embedded in the sidewall of the refrigerating space 15, that is, the sidewall of the inner case 14, so that a box withdrawal detection switch to be described may be improperly installed. This is because the box withdrawal detection switch and the ducts 51 and 52 interfere.

The switching space 16 and the freezing space 17 may be opened and closed by the switching space door 41 and the freezing space door 45 which may be retracted and withdrawn in the form of a drawer, and a drawer-type storage space may be provided in the switching space door 41 and the freezing space door 45.

Figure 4:
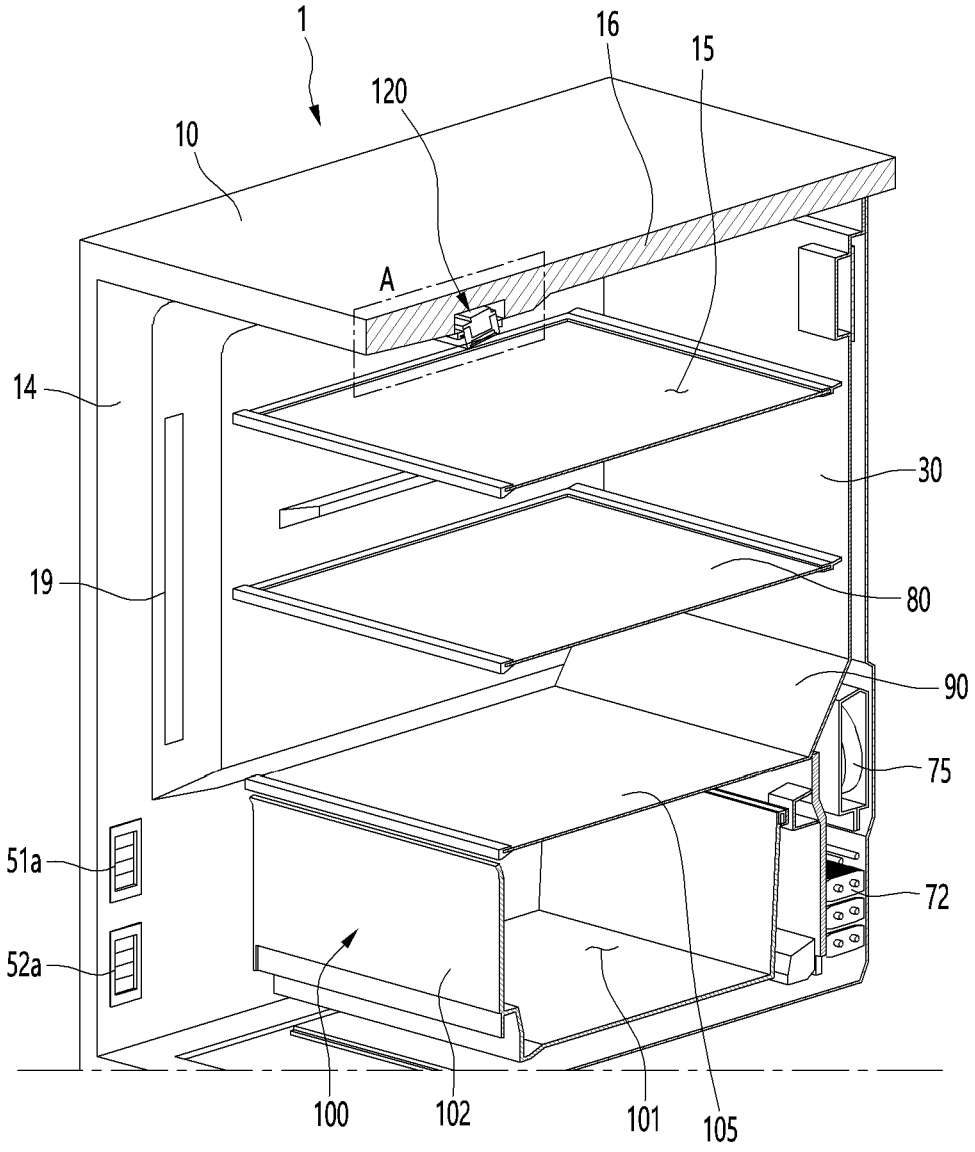
FIG. 4 is a cross-sectional view taken along line 4-4' of FIG. 2.
Figure 5:
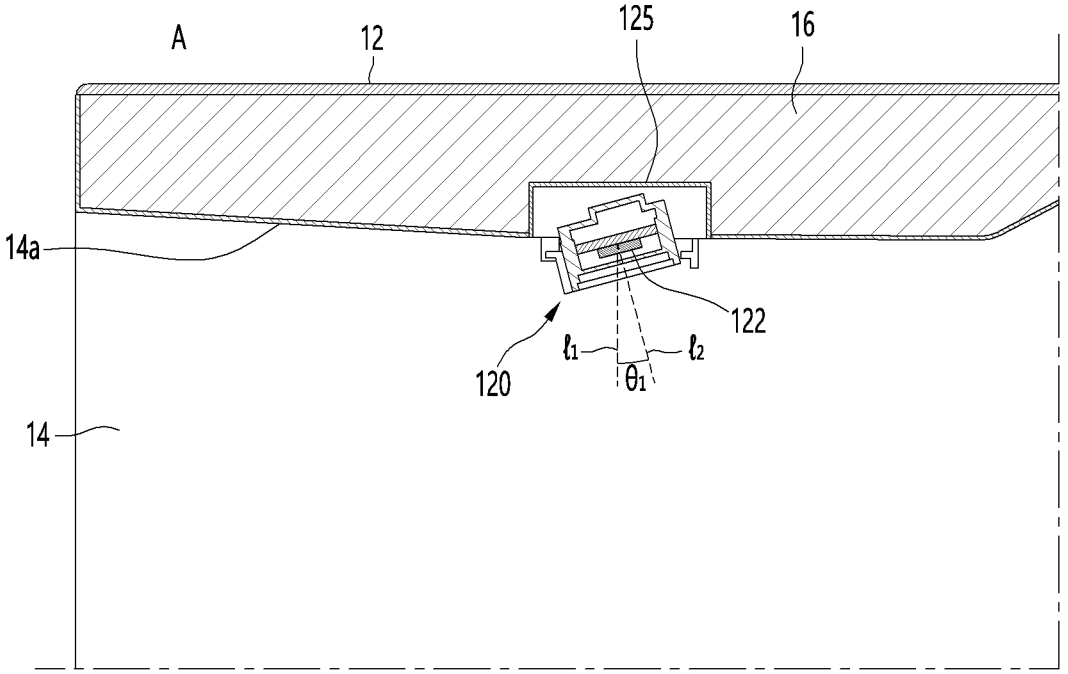
FIG. 5 is an enlarged cross-sectional view of part "A" of FIG. 4.
Figure 6:
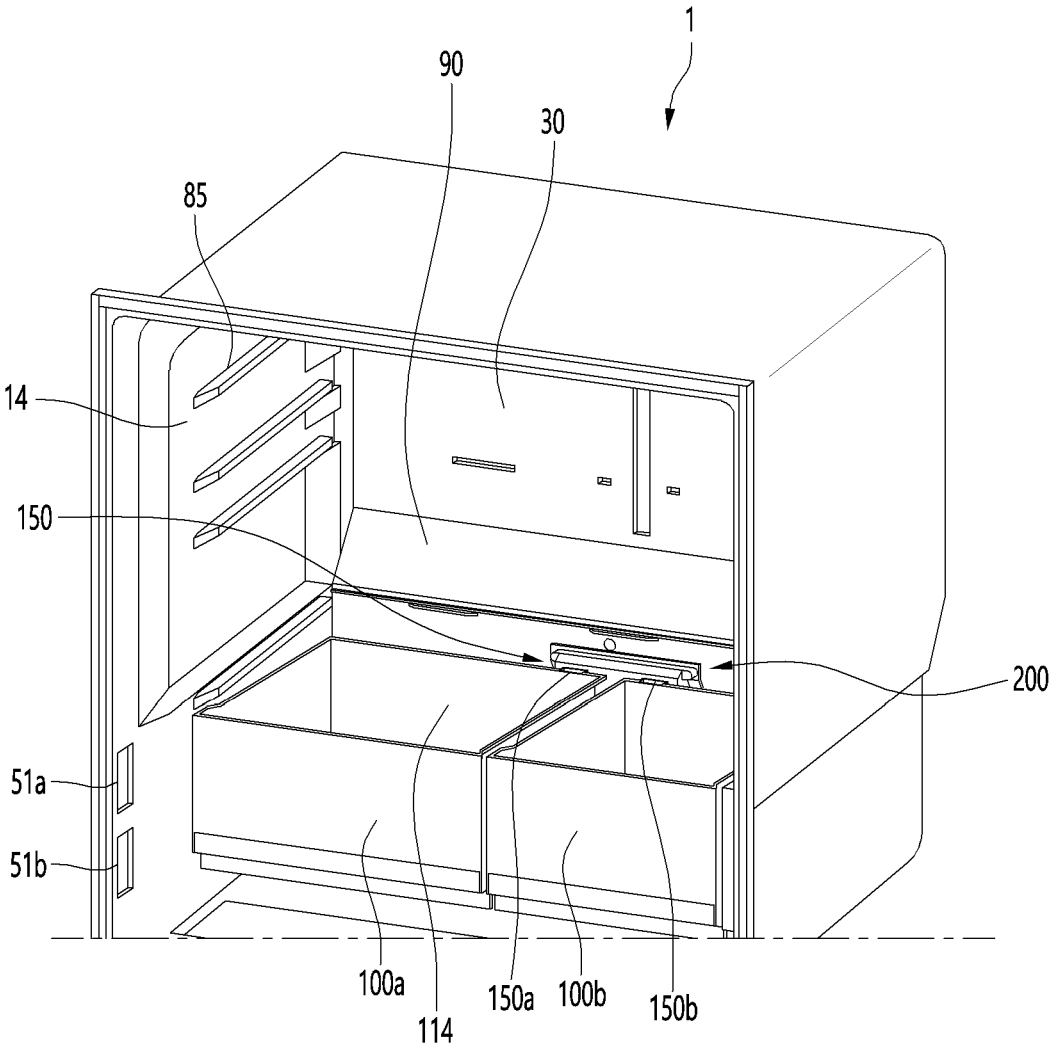
FIG. 6 is a view showing the inside of a refrigerating space according to an embodiment of the present disclosure.

FIG. 4 is a cross-sectional view taken along line 4-4' of FIG. 2. FIG. 5 is an enlarged cross-sectional view of part "A" of FIG. 4. FIG. 6 is a view showing the inside of a refrigerating space according to an embodiment of the present disclosure.

Referring to FIGS. 4 to 6, a shelf 80 for accommodating stored objects may be provided inside the refrigerating space 15 according to the embodiment of the present disclosure. A plurality of shelves 80 may be provided, and the plurality of shelves 80 may be provided to be spaced apart from each other in the vertical direction.

A shelf bracket 85 for supporting the shelves 80 may protrude from the sidewall of the inner case 14.

A real wall of the refrigerating space 15 is provided with a multi-duct 30. The multi-duct 30 is provided to be spaced apart from the front side of a rear portion of the inner case 14, and a cold air flow path may be formed between the multi-duct 30 and the rear portion of the inner case 14. Cold air which has passed through the refrigerating space fan 75 may flow through the cold air flow path.

A duct discharge hole 32 is formed in the multi-duct 30, and cold air flowing through the cold air flow path may be supplied to the refrigerating space 15 through the duct discharge hole 32. For example, a plurality of duct discharge holes 32 may be formed in a central portion of the multi-duct 30 in the vertical direction.

A grille fan 90 is provided on a rear wall of the refrigerating space 15. The grille fan 90 may be disposed in front of the refrigerating space evaporator 72 and the refrigerating space fan 75 to cover the refrigerating space evaporator 72 and the refrigerating space fan 75.

The grille fan 90 is provided to be spaced apart from the front side of the rear portion of the inner case 14, and a heat exchange space in which the refrigerating space evaporator 72 and the refrigerating space fan 75 are disposed may be formed between the grille fan 90 and the rear portion of the inner case 14.

The refrigerating space fan 75 may be located above the refrigerating space evaporator 72.

The grille fan 90 may be provided below the multi-duct 30. The grille fan 90 and the multi-duct 30 may form the rea wall of the refrigerating space 15.

An illumination source (not shown) for illuminating the inside of the refrigerating space 15 may be installed on the sidewall of the inner case 14. The illumination source may be shielded by an illumination source cover 19.

In the refrigerating space 15, a box 100 which may be withdrawn forward or retracted rearward may be provided. For example, the box may include a vegetable box in which stored objects such as vegetables are accommodated.

The box 100 may be provided at the lower portion of the refrigerating space 15, and may be located in front of the grille fan 90.

The box 100 may have a hexahedral shape and have an open upper portion.

The box 100 forms a box storage space 101 in which stored objects are accommodated and includes a box body 102 with an open upper portion and a box cover 105 covering the upper portion of the box body 102.

A plurality of boxes 100 may be provided. The plurality of boxes 100 may be arranged in a left-and-right direction. Specifically, the plurality of boxes 100 includes a first box 100*a* and a second box 100*b*.

A front portion of the box 100 faces a front portion of the cabinet 10, and a rear portion 114 faces a rear portion of the cabinet 10. For example, the rear portion 114 of the box 100 may be configured to face the grille fan 90.

A detection device for detecting withdrawal or retraction of the box 100 may be provided on the rear portion of the box 100 and the rear wall of the refrigerating space 15. The detection device may include a switch 230 and a magnetic assembly 150.

The switch 230 and the magnetic assembly 150 perform magnetic operation, and an on or off signal may be applied to the switch 230 based on a distance from the magnetic assembly 150.

For example, the switch 230 may be provided in the grille fan 90. The magnetic assembly 150 may be provided in the box 100. However, the present disclosure is not limited to such positions and the switch 230 may be provided in the box 100 and the magnetic assembly 150 may be provided in the grille fan 90.

The magnetic assembly 150 includes a first assembly 150*a* provided in the first box 100*a* and a second assembly 150*b* provided in the second boxy 100*b*.

The switch 230 includes a first switch 230*a* performing operation with the first assembly 150*a* and a second switch 230*b* performing operation with the second assembly 150*b*.

The switch 230 may be supported on the grille fan 90 by a switch cover 200. The switch cover 200 may be mounted on the grille fan 90, and the switch 230 may be fixed to the switch cover 200. The switch 230 may be exposed on a front surface of the switch cover 200 and may face the magnetic assembly 150.

The first and second switches 230*a* and 230*b* may be supported on the switch cover 200, and may be disposed to be spaced apart from each other in the left-and-right direction.

An upper wall of the refrigerating space 15 may be provided with a camera 120 for capturing the image of the stored objects stored in the box 100. The upper wall of the refrigerating space 15 may be formed by the upper portion 14*a* of the inner case 14.

The camera 120 may receive an imaging start signal according to a signal detected by the switch 230 when the box 100 is withdrawn by a predetermined distance, and capture an image to acquire the image of the stored objects inside the box 100.

The acquired image may be stored in the refrigerator and output through a display of the refrigerator to inform the user of information about the stored food.

The refrigerator 1 may further include a support bracket 125 that is provided on the upper wall of the refrigeration space 15 to support the camera 120. The support bracket 15 may be installed on the upper portion 14*a* of the inner case 14 and embedded in the heat insulating material 16.

The support bracket 125 may have a cap shape with an open lower portion. The camera 120 may be installed on the open lower portion of the support bracket 125.

The camera 120 may be located in front of a front end of the shelf 80 to form an angle of view such that the shelf 80 does not obstruct the capturing of the image of the inside of the box 100. That is, the camera 120 may be provided at a position closer to the front end than to the rear end of the upper wall of the refrigerating space 15.

The camera 120 may include a lens 122 forming an angle of view downward toward the box 100.

The lens 122 may be disposed to be inclined toward the rear side. Specifically, when a vertical line $\ell 1$ passing through the center of the lens 120 is defined, the angle of view of the lens 122 may be inclined by a set angle $\theta 1$ toward the rear side. By such an arrangement of the angle of view of the lens 122, even if the box 100 is not sufficiently withdrawn, it is possible to easily obtain an image related to the stored objects in the box 100.

Figure 7:
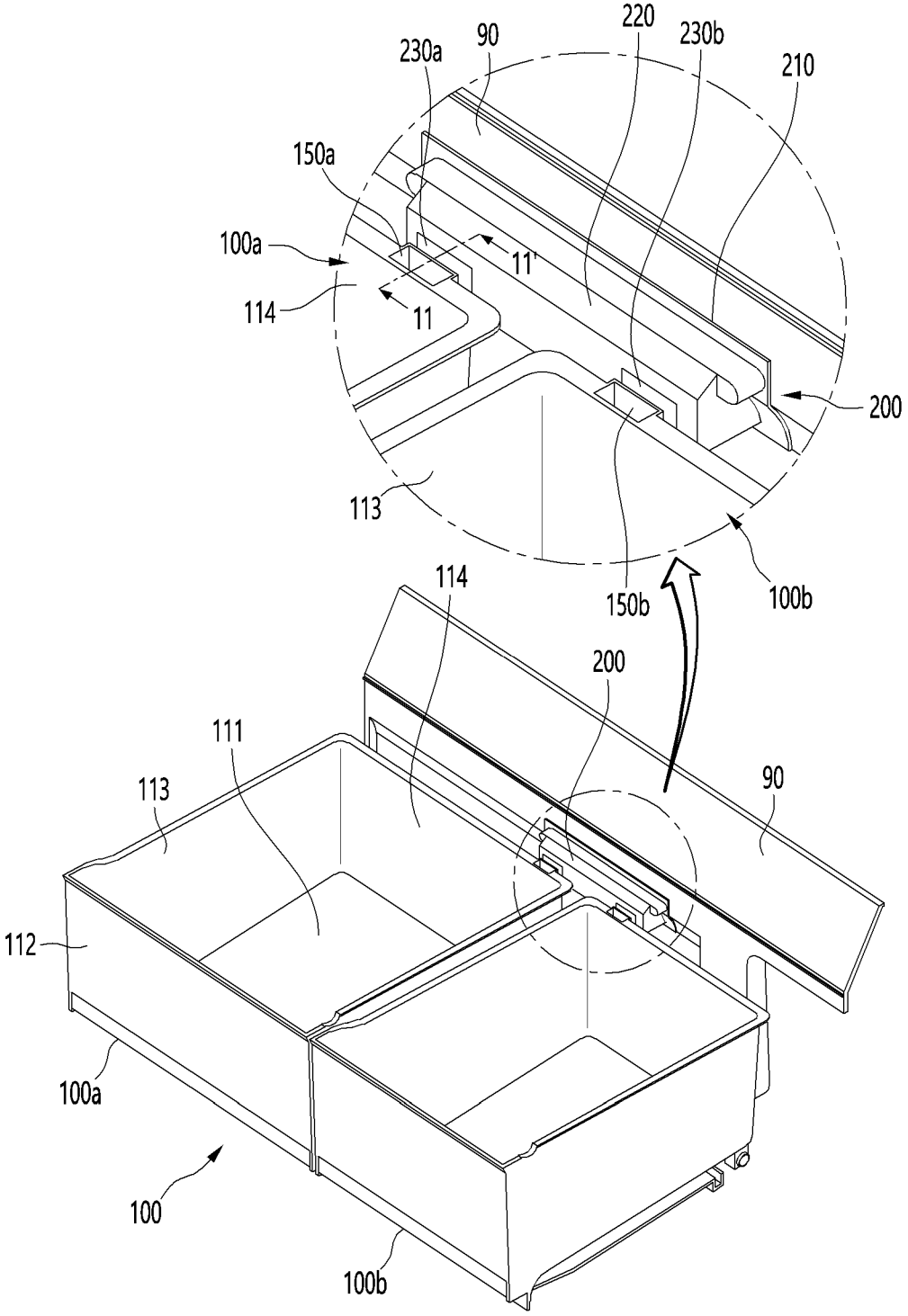
FIG. 7 is a view showing a configuration of a box and a grille fan according to an embodiment of the present disclosure.
Figure 8:
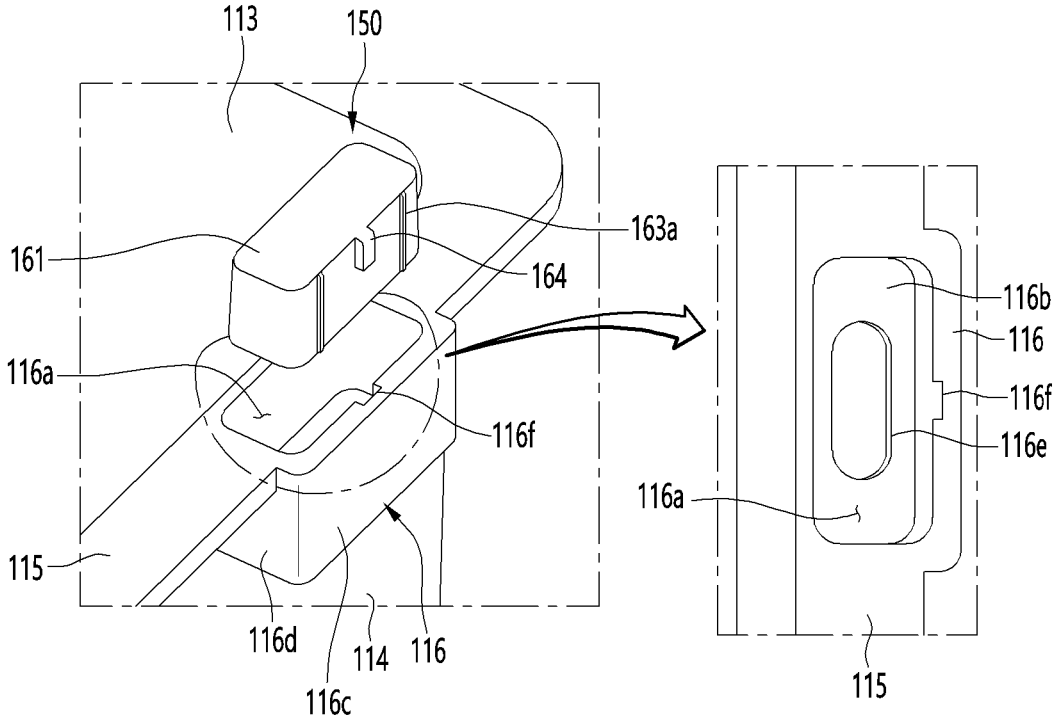
FIG. 8 is a view showing a configuration of a rear portion of a box according to an embodiment of the present disclosure.
Figure 9:
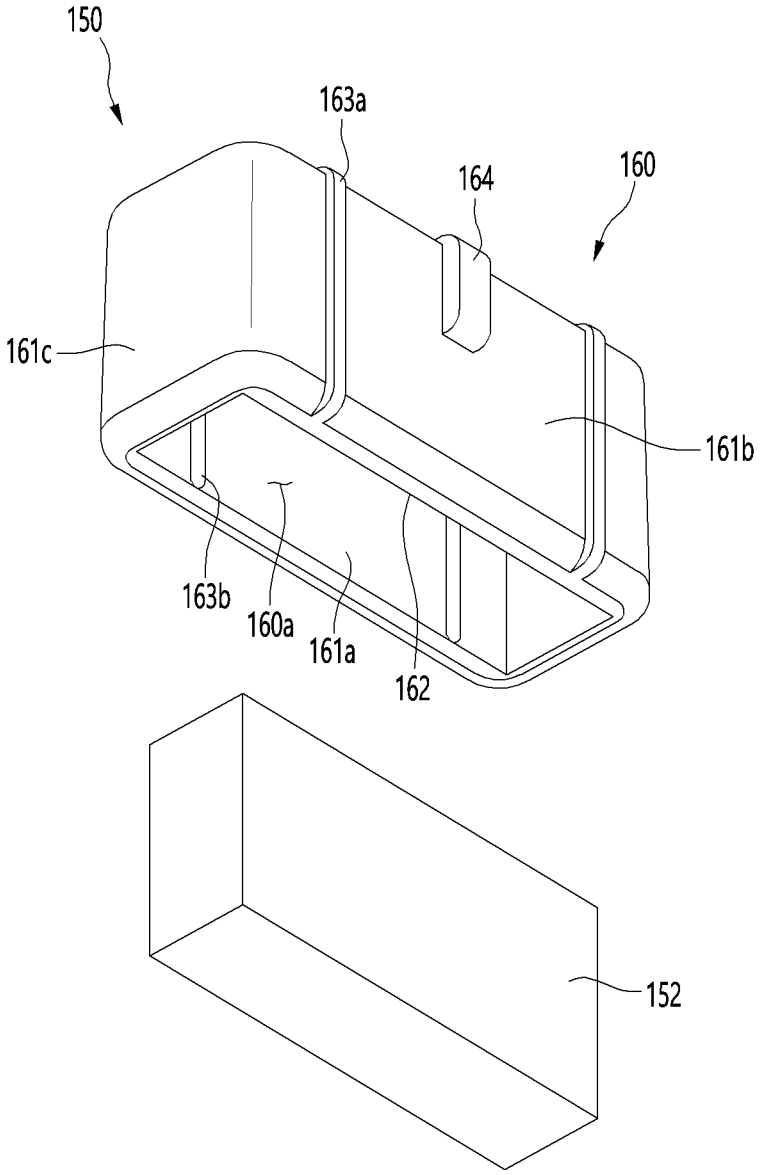
FIG. 9 is an exploded perspective view showing a configuration of a magnetic assembly according to an embodiment of the present disclosure.
Figure 10:
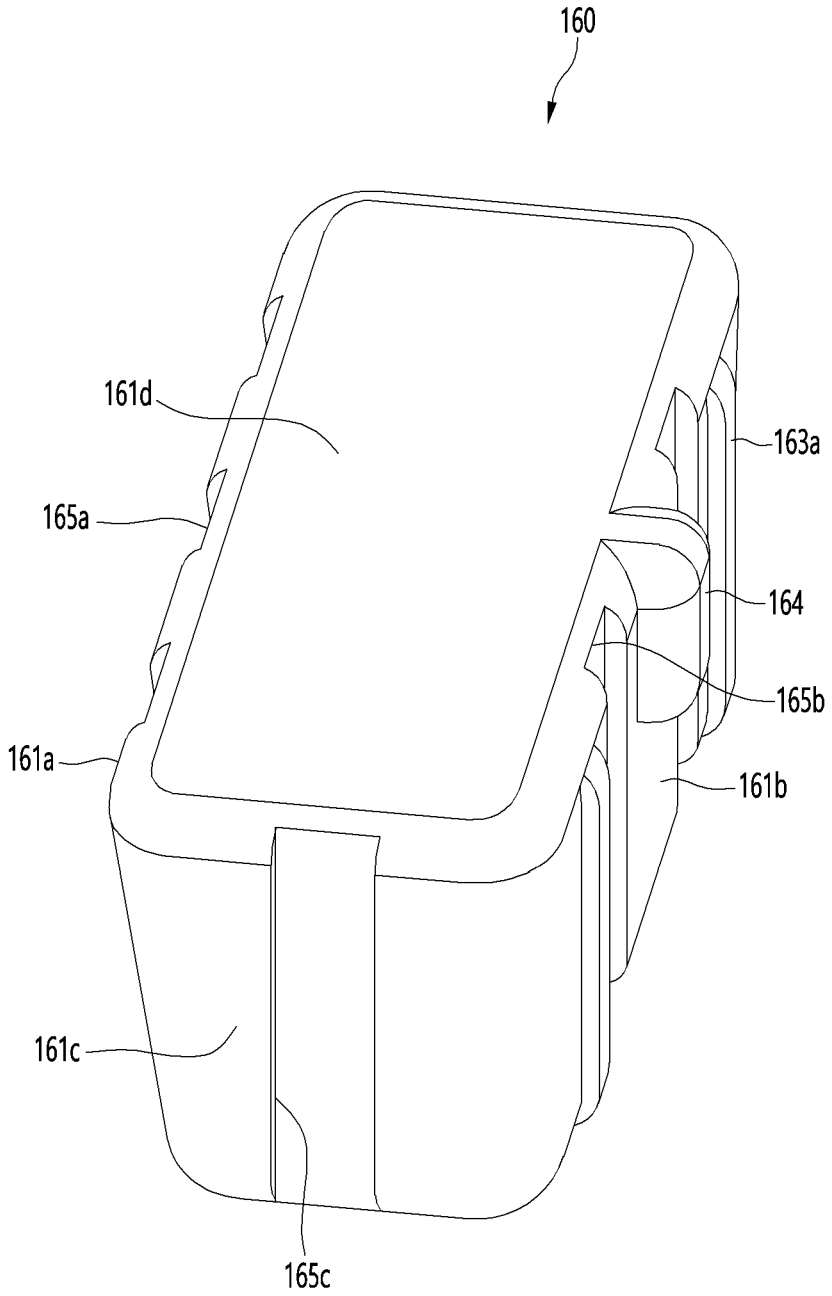
FIG. 10 is a view showing a configuration of a magnetic cover according to an embodiment of the present disclosure.
Figure 11:
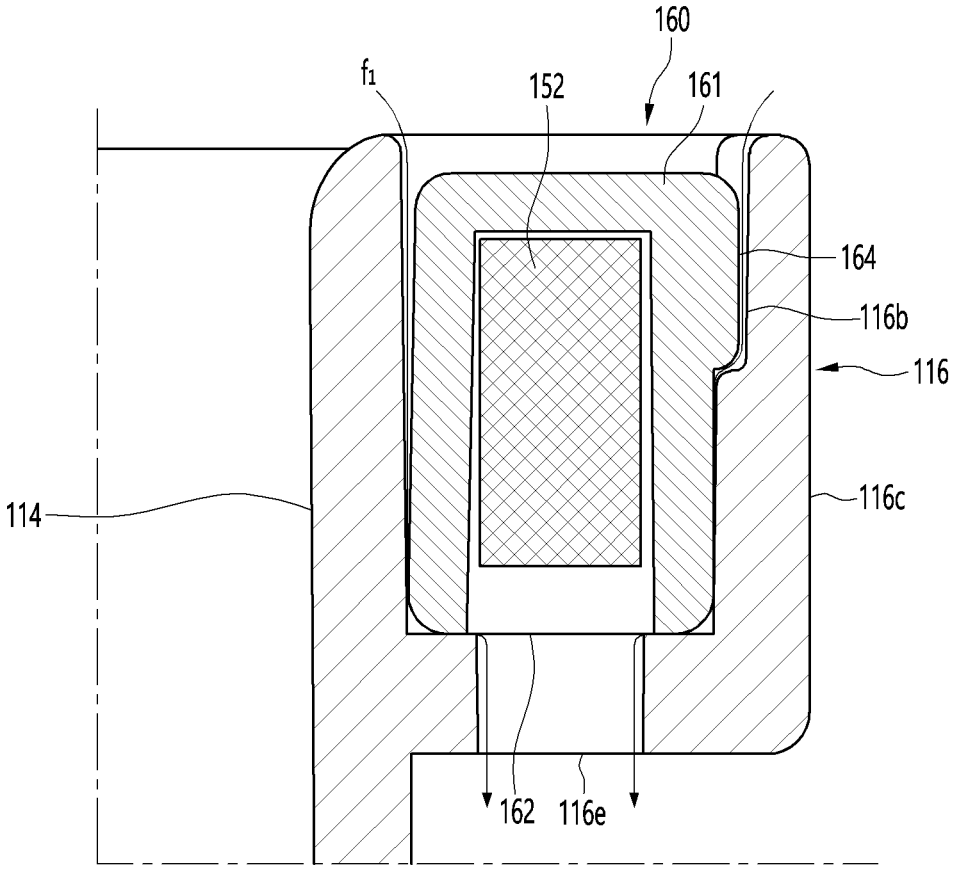
FIG. 11 is a cross-sectional view taken along line 11-11' of FIG. 7.

FIG. 7 is a view showing a configuration of a box and a grille fan according to an embodiment of the present disclosure. FIG. 8 is a view showing a configuration of a rear portion of a box according to an embodiment of the present disclosure. FIG. 9 is an exploded perspective view showing a configuration of a magnetic assembly according to an embodiment of the present disclosure. FIG. 10 is a view showing a configuration of a magnetic cover according to an embodiment of the present disclosure. FIG. 11 is a cross-sectional view taken along line 11-11' of FIG. 7.

First, referring to FIG. 7, a box 100 may be provided in front of the grille fan 90 according to the embodiment of the present disclosure. The box 100 includes a first box 110*a* and a second box 100*b*, and the first and second boxes 100*a* and 100*b* may be disposed in front of the grille fan 90 in the left-and-right direction.

The box 100 may have a rectangular parallelepiped shape with an open upper portion. Specifically, the box 100 includes a bottom portion 111, two side portions 113 extending upward from both sides of the bottom portion 111, a front portion 112 extending upward from an front end of the bottom portion 111 and a rear portion 114 extending upward from a rear end of the bottom portion 111.

The rear portion 114 of the box 100 may be disposed to face the grille fan 90, and may be provided with the magnetic assembly 150. The magnetic assembly 150 may be disposed to be exposed to the outside through the upper end of the box 100.

The magnetic assembly 150 includes a first assembly 150*a* provided in the rear portion of the first box 100*a* and a second assembly 150*b* provided in the rear portion of the second box 100*b*.

The grille fan 90 is disposed to face the rear portion 114 of the box 100. The grille fan 90 is provided with the switch cover 200 supporting a switch 230. The switch cover 200 may protrude forward from the grille fan 90, and may be detachably coupled to the grille fan 90.

Specifically, the switch cover 200 includes a fan coupling portion 210 coupled to the grille fan 90 and a cover housing 220 protruding forward from the fan coupling portion and forming an accommodation space of the switch 230 therein.

A plurality of switches 230 may be provided. The switch 230 may include a first switch 230*a* for performing a magnetic operation with the first assembly 150*a* and a second switch 230*b* for performing a magnetic operation with the second assembly 150*b*.

The first and second switches 230*a* and 230*b* may be supported on the switch cover 200. Specifically, the first and second switches 230*a* and 230*b* may be detachably coupled to the switch cover 200. The first and second switches 230*a* and 230*b* may be disposed to be spaced apart from each other in the left-and-right direction of the switch cover 200.

Front surfaces of the first and second switches 230*a* and 230*b* may be exposed on a front surface of the switch cover 200 to respectively face the first and second assemblies 150*a* and 150*b*.

Hereinafter, the installation structure of the box 100 of the magnetic assembly 150 will be described.

Referring to FIGS. 8 to 10, the magnetic assembly 150 according to the embodiment of the present disclosure may be inserted into a pocket 116 provided in the box 100.

Specifically, the box 100 may include an edge portion 115 of an open upper end. The edge portion 115 may be provided with a pocket 116 which is depressed downward to form an accommodation space 116*a* of the magnetic assembly 150.

The pocket 116 may be provided on the rear portion 114 of the box 100 and may be provided to protrude backward.

The pocket 116 includes a pocket bottom portion 116*b* for supporting a lower end of the magnetic assembly 150, a pocket rear portion 116*c* extending upward from a rear end of the pocket bottom portion 116*b*, and pocket side portions 116*d* extending upward from both sides of the pocket bottom portion 116*b*.

The front portion of the pocket 116 forms the rear portion 114 of the box 100.

A pocket hole 116*e* is formed in the pocket bottom portion 116*b*. The pocket hole 116*e* may be formed to be smaller than a bottom surface of the magnetic assembly 150 so that the magnetic assembly 150 is not separated downward. The pocket hole 116*e* may function as a drain hole through which liquid or moisture of the stored object is discharged.

The magnetic assembly 150 may be configured to have a size that can be inserted into the accommodation space 116*a* of the pocket 116. For example, the magnetic assembly 150 may be press-fitted into the pocket 116.

The magnetic assembly 150 may have a rectangular parallelepiped shape.

The magnetic assembly 150 is provided with an assembly rib 164. The assembly rib 164 may protrude from an outer surface of the magnetic assembly 150. For example, the assembly rib 164 may protrude from a rear surface of the magnetic assembly 150 and may be configured to extend downwardly by a predetermined length from the upper end of the magnetic assembly 150.

An assembly groove 116*f* into which the assembly rib 164 is inserted may be formed in the pocket 116. The assembly groove 116*f* may be depressed in the inner surface of the pocket 116. For example, the assembly groove 116*f* may be configured to be depressed downwardly into the upper end of the pocket rear portion 116*c*.

Since the assembly rib 164 is configured to be inserted into the assembly groove 116*f*, erroneous assembling of the magnetic assembly 150 may be prevented and the magnetic assembly 150 may be easily mounted.

The magnetic assembly 150 includes a first contact rib 163*a*. The first contact rib 163*a* may protrude from the outer surface of the magnetic assembly 150. For example, the assembly rib 164 may protrude from the rear surface of the magnetic assembly 150 and may be configured to extend from an upper end to a lower end of the magnetic assembly 150.

A plurality of first contact ribs 162*a* is provided, and the assembly rib 164 may be provided between the plurality of first contact ribs 163*a*.

When the magnetic assembly 150 is inserted into the pocket 116, the first contact rib 163*a* may contact the inner surface of the pocket 116. As the first contact rib 163*a* contacts the inner surface of the pocket 116, the magnetic assembly 150 may be press-fitted into the pocket 116.

The magnetic assembly 150 includes a magnet 152 having magnetic properties and a magnetic cover 160 for accommodating the accommodation space 160*a* of the magnet 152.

For example, the magnet 152 may have a rectangular parallelepiped shape.

The accommodating space 160*a* of the magnetic cover 160 is formed to have a size that allows the magnet 152 to be inserted, and the magnet 152 may be press-fitted into the magnetic cover 160.

The lower end of the magnetic cover 160 is opened. The magnet 152 may be inserted upward through the opened lower end of the magnetic cover 160.

The magnetic cover 160 includes a cover front portion 161*a*, a cover rear portion 161*b* provided opposite to the cover front portion 161*a* and cover side portions 161*c* extending backward from both sides of the cover front portion 161*a*. The cover side portions 161*c* may connect the cover front portion 161*a* and the cover rear portion 161*b*.

The magnetic cover 160 further includes a cover upper portion 161*d* connecting the upper ends of the cover front portion 161*a* and the cover rear portion 161*b*. The cover upper portion 161*d* may cover an upper side of the magnetic 150. Since the cover upper portion 161*d* is provided, it is possible to prevent the magnet 152 from being contaminated even if the liquid is poured into the magnetic assembly 150.

The assembly rib 164 and the first contact rib 163*a* may be provided on the outer surface of the cover rear portion 161*b*.

A second contact rib 163*b* in contact with the magnet 152 may be provided on the inner surface of the cover front portion 161*a*. The second contact rib 163*b* may extend from an upper end to a lower end of the cover front portion 161*a*.

As the second contact rib 163*b* contacts the inner surface of the magnetic cover 160, the magnet 152 may be press-fitted to the magnetic cover 160.

In the magnetic assembly 150, a drain groove forming a drain passage of the fluid may be formed. The drain groove may be recessed in the outer surface of the magnetic cover 160.

A plurality of drain grooves may be formed in the magnetic cover 160. The drain groove includes a first drain groove 165*a* formed in the cover front portion 161*a*, a second drain groove 165*b* formed in the cover rear portion 161*b*, and a third drain groove 165*c* formed in the cover side portion 161*c*.

A plurality of first drain grooves 165*a* and second drain grooves 165*b* may be formed, respectively. Although one third drain groove 165*c* is shown in the drawing, a plurality of third drain grooves 165*c* may be formed.

Referring to FIG. 11, when the liquid or moisture f1 of the stored object is poured into the pocket 116, the liquid does not flow into the magnet 152 by the cover upper portion 161*d* of the magnetic cover 160.

The liquid may flow downward through the plurality of drain grooves 165*a*, 165*b* and 165*c*. That is, the liquid flows downward through a space between the plurality of drain grooves 165*a*, 165*b*, and 165*c* and the surface of the pocket 116, and may be drained to the lower side of the pocket 116 through the pocket hole 116*e*.

In this way, even if the liquid is poured toward the magnetic assembly 150, since it is easily drained to the lower side of the magnetic assembly 150, it is possible to prevent the magnetic assembly 150 from being contaminated.

Figure 12:
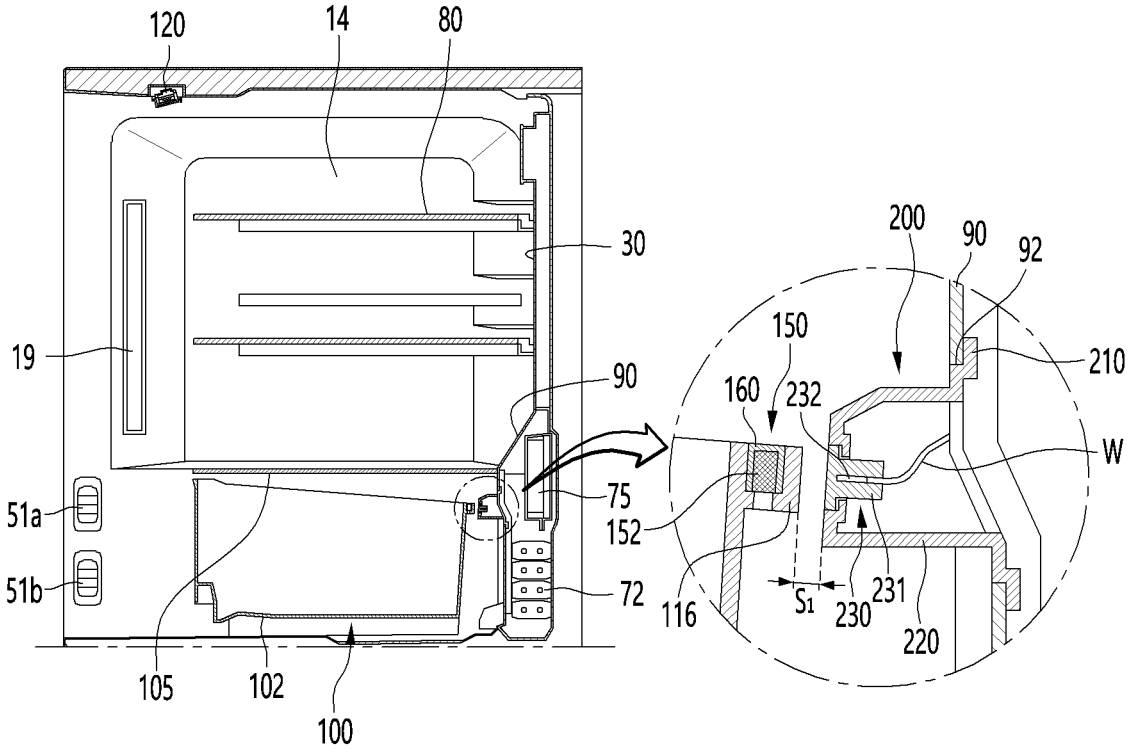
FIG. 12 is a side cross-sectional view of a refrigerator taken along line 12-12' of FIG. 2.
Figure 13:
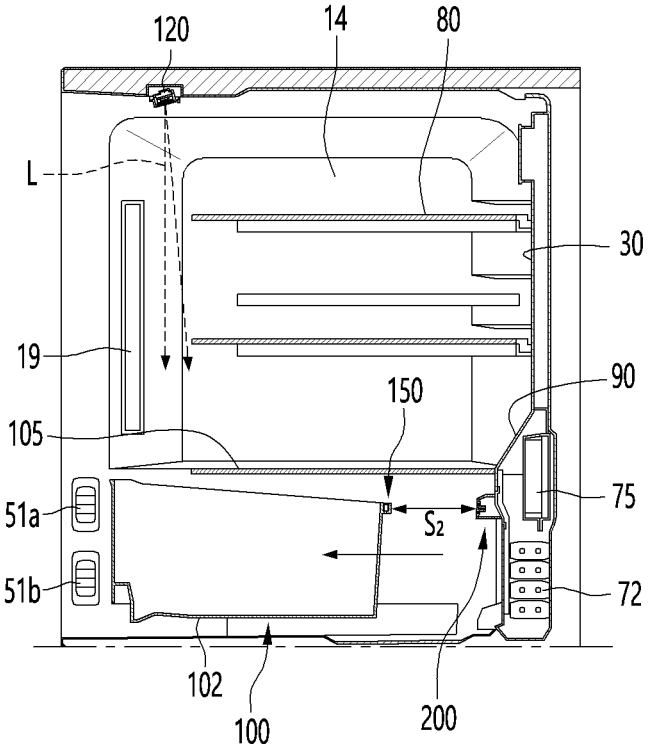
FIG. 13 is a side cross-sectional view of a refrigerator according to an embodiment of the present disclosure, which shows a state in which a box is withdrawn forward.

FIG. 12 is a side cross-sectional view of a refrigerator taken along line 12-12' of FIG. 2. FIG. 13 is a side cross-sectional view of a refrigerator according to an embodiment of the present disclosure, which shows a state in which a box is withdrawn forward.

Referring to FIG. 12, a magnetic assembly 150 is provided on the rear portion of the box 100 according to an embodiment of the present disclosure, and the switch 230 mounted on the grille fan 90 may be provided at the rear side of the box 100.

The switch 230 is coupled to the switch cover 200, and the switch cover 200 may be assembled into the cover hole 92 of the grille fan 90. The front surface of the switch 230 forms the same surface as the front surface of the switch cover 200 and may be exposed towards the refrigeration space 15.

The switch 230 includes a switch body 231 assembled in the switch cover 200. The switch body 231 is provided with a terminal 232. A pair of terminals 232 may be provided and may be connected to a lead wire W.

FIG. 12 shows a state in which the box 100 is retracted. In a state in which the box 100 is retracted, the magnetic assembly 150 is positioned adjacent to the switch 230. For example, as shown in the figure, a first set distance S1 is formed between the magnetic assembly 150 and the switch 230, and, at this time, the switch 230 may detect the magnet 152 and generate a signal (e.g., an on signal) indicating that the box 100 is retracted.

When the switch 230 generates an on signal, since the box body 102 is in a closed state by the box cover 105, the camera 120 may not capture an image.

FIG. 13 shows a state in which the box 100 is withdrawn forward by a predetermined distance. In a state in which the box 100 is withdrawn by the predetermined distance, the magnetic assembly 150 may be in a state of being spaced apart from the switch 230 by a second set distance S2. In this case, the switch 230 may generate a signal (e.g., an off signal) indicating that the box 100 is in a state of being withdrawn without detecting the magnet 152.

When the switch 230 generates an off signal, since the upper portion of the box body 110 is in an open state, the camera 120 may capture (L) the image of the inside of the box body 102. The captured image is stored, and the stored image is output through the display of the refrigerator to help the user to recognize the objects stored in the box 100.

A method of operating the switch and the camera according to the present embodiment will be briefly described.

When the refrigerating space door 20 is opened, it is recognized that the refrigerating space door 20 is opened by a door switch (not shown), and the power of the camera 120 may be turned on.

As shown in FIG. 12, in a state that the box 100 is retracted, the camera 120 does not capture the image by the detection of the switch 230, and, when detecting that the box 100 is withdrawn, the camera 120 may capture the image by the signal of the switch 230.

As an example, when detecting that the box 100 is withdrawn by a predetermined distance (e.g., in the range of 100 mm to 150 mm), or when a predetermined time (e.g., 1 to 2 seconds) elapses after the box 100 starts to be withdrawn, the camera 120 may capture an image.

The image obtained as a result of the capturing the image is stored in the refrigerator, and, when the refrigerating space door 20 is closed, the obtained image may be output through the display of the refrigerator. The user may perform food management by using the output image.

INDUSTRIAL AVAILABILITY

According to the present disclosure, by providing a switch on the rear wall of the storage space of the refrigerator to detect whether the vegetable box is withdrawn, it is possible to prevent interference between the switch and the cold air duct for the sidewall of the storage space. Therefore, industrial applicability is remarkable.

What is claimed is:

1. A refrigerator comprising:
a cabinet forming a storage space;
a door configured to open and close the storage space;
a bin provided in the storage space and configured to be withdrawn forward;
a pocket that is protruded from a rear portion of the bin;
a magnet received in the pocket;
a magnetic cover forming a space into which the magnet is inserted, the magnetic cover being inserted into the pocket and including
a cover front wall and a cover rear wall facing each other,
cover side walls at sides of the cover front wall, and
a cover upper wall connecting the cover front wall and the cover rear wall;
a switch provided on a rear wall of the storage space and configured to detect the magnet; and
a camera provided above the bin and configured to capture an image of an interior of the bin when the bin is withdrawn based on the switch not detecting the magnet,
wherein the pocket comprises:
a pocket bottom wall, a pair of pocket side walls and a pocket rear wall that define an accommodation space for the magnet;
a first opening formed in upper ends of the pair of pocket side walls and the pocket rear wall and through which the magnet is inserted; and
a second opening formed in the bottom wall and through which a fluid in the accommodation space is discharged, and
wherein the magnetic cover comprises a drain groove that is recessed from an outer surface of the magnetic cover, the drain groove being formed in at least one of the cover front wall, the cover rear wall, or the cover side walls of the magnetic cover and being configured to allow the fluid in the pocket to drain via the second opening.

2. The refrigerator of claim 1, further comprising a grille fan forming the rear wall of the storage space,
wherein the rear portion of the bin faces the grille fan.

3. The refrigerator of claim 1,
wherein the bin includes a body having an open top and a cover covering an upper side of the body, and
wherein the pocket is provided in an upper edge of the body.

4. The refrigerator of claim 1, wherein a size of the second opening is less than a size of a bottom of the magnet.

5. The refrigerator of claim 1,
wherein the magnetic cover includes a cover opening into which the magnet is inserted, and
wherein an upper side of the magnet is shielded by the cover upper wall.

6. The refrigerator of claim 1, wherein the magnetic cover includes an assembly rib that is inserted into an assembly groove formed in an inner surface of the pocket.

7. The refrigerator of claim 1, further comprising a first contact rib provided on an outer surface of the magnetic cover,
wherein the first contact rib contacts an inner surface of the pocket so that the magnetic cover is press-fitted into the pocket.

8. The refrigerator of claim 1, further comprising a second contact rib provided in an inner surface of the magnetic cover,
wherein the second contact rib contacts the magnet so that the magnet is press-fitted into the magnetic cover.

9. The refrigerator of claim 1, further comprising a switch cover mounted on the grilled fan and forming an installation space of the switch, the switch cover having an opening,
wherein the switch is exposed toward the bin through the opening of the switch cover so that the switch faces the magnet.

10. The refrigerator of claim 1,
wherein the rear portion of the bin is positioned to face the grille fan, and
wherein the magnet is positioned between the rear portion of the bin and the grille fan.

11. The refrigerator of claim 1, wherein the magnet is configured to move with the bin by retraction or withdrawal of the bin.

12. The refrigerator of claim 1,
wherein the bin further includes an upper edge defining an open top, and
wherein the pocket is mounted on the upper edge of the bin such that the first opening of the pocket is formed at the upper edge.

13. The refrigerator of claim 1, further comprising a shelf provided in the storage space,
wherein the camera is located in front of a front end of the shelf such that the camera has an angle of view that is not obstructed by the shelf when capturing of the image of the interior of the bin.

14. The refrigerator of claim 13, wherein the camera includes a lens that is positioned to be inclined toward a rear of the storage space.

15. The refrigerator of claim 1,
wherein the magnet is positioned adjacent to the switch when the bin is not withdrawn, and
wherein the camera is configured to capture the image of the interior of the bin when the bin is withdrawn, and a distance from the magnet to the switch is greater than a predetermined distance.

* * * * *